US011352961B2

(12) United States Patent
Zhan et al.

(10) Patent No.: US 11,352,961 B2
(45) Date of Patent: Jun. 7, 2022

(54) VALVE ROCKER ARM ASSEMBLY, VARIABLE AIR DISTRIBUTION MECHANISM AND ENGINE

(71) Applicant: WEICHAI POWER CO., LTD., Shandong (CN)

(72) Inventors: Qiang Zhan, Shandong (CN); Jibin Zhu, Shandong (CN); Zhiqiang Li, Shandong (CN)

(73) Assignee: WEICHAI POWER CO., LTD., Shandong (CN)

( * ) Notice: Subject to any disclaimer, the term of this patent is extended or adjusted under 35 U.S.C. 154(b) by 0 days.

(21) Appl. No.: 16/753,844

(22) PCT Filed: Dec. 28, 2017

(86) PCT No.: PCT/CN2017/119260
§ 371 (c)(1),
(2) Date: Apr. 6, 2020

(87) PCT Pub. No.: WO2019/127188
PCT Pub. Date: Jul. 4, 2019

(65) Prior Publication Data

US 2020/0318554 A1 Oct. 8, 2020

(51) Int. Cl.
*F02D 13/02* (2006.01)
*F01L 1/18* (2006.01)
(Continued)

(52) U.S. Cl.
CPC ..... *F02D 13/0234* (2013.01); *F01L 1/04* (2013.01); *F01L 1/14* (2013.01); *F01L 1/181* (2013.01);
(Continued)

(58) Field of Classification Search
CPC ..... F01L 1/04; F01L 1/14; F01L 1/181; F01L 1/18; F01L 1/245; F01L 1/46;
(Continued)

(56) References Cited

U.S. PATENT DOCUMENTS 2,239,920 A * 4/1941 Mahan ..... F01B 31/10 184/27.1
4,627,391 A * 12/1986 Derringer ..... F02D 13/0257 123/90.16
(Continued)

FOREIGN PATENT DOCUMENTS

CN 102840005 A 12/2012
CN 103266927 A 8/2013
(Continued)

OTHER PUBLICATIONS

International Search Report for International application No. PCT/CN2017/119260; dated Jul. 31, 2018.
(Continued)

*Primary Examiner* — Devon C Kramer
*Assistant Examiner* — Kelsey L Stanek
(74) *Attorney, Agent, or Firm* — Cantor Colburn LLP

(57) ABSTRACT

A valve rocker arm assembly, a variable air distribution mechanism, and an engine are provided according to the present disclosure. The valve rocker arm assembly includes: an oil inlet hose; a rocker arm shaft, an oil drain channel, an oil return groove, and a first oil path being provided in the rocker arm shaft, the oil drain channel being communicated with the oil return groove by means of the first oil path; a first rocker arm and a second rocker arm rotatably connected onto the rocker arm shaft, a piston cavity, an oil inlet path, an oil drain path and a piston being provided on the second rocker arm; a one-way opening device provided in the oil
(Continued)

inlet path and/or the oil inlet hose; and a control valve connected to the oil drain channel.

19 Claims, 5 Drawing Sheets

(51) Int. Cl.

| | |
|---|---|
| ***F01L 1/04*** | (2006.01) |
| ***F01L 1/14*** | (2006.01) |
| ***F01L 1/46*** | (2006.01) |
| ***F01M 1/16*** | (2006.01) |
| ***F01M 9/10*** | (2006.01) |
| ***F01L 13/00*** | (2006.01) |
| ***F01L 1/24*** | (2006.01) |

(52) U.S. Cl.
CPC ..... *F01L 1/2416* (2013.01); *F01L 1/462* (2013.01); *F01L 13/0031* (2013.01); *F01M 1/16* (2013.01); *F01M 9/10* (2013.01); *F01L 2001/186* (2013.01); *F01L 2001/2444* (2013.01)

(58) Field of Classification Search
CPC ... F01L 1/462; F01L 13/0015; F01L 13/0021; F01L 1/2416; F01L 2001/186; F01M 1/16; F01M 9/10; F02D 13/0234; F02D 13/00
USPC ..... 123/90.15–90.17, 90.36, 90.44, 90.46
See application file for complete search history.

(56) References Cited

U.S. PATENT DOCUMENTS

| | | | | |
|---|---|---|---|---|
| 5,107,803 | A * | 4/1992 | Furnivall | F01L 1/181 123/90.16 |
| 5,113,813 | A * | 5/1992 | Rosa | F01L 13/0063 123/90.16 |
| 5,758,620 | A * | 6/1998 | Warner | F01L 13/06 123/321 |
| 8,434,451 | B2 * | 5/2013 | Yoon | F01L 13/06 123/321 |
| 8,904,982 | B2 | 12/2014 | Lowe | |
| 2011/0290206 | A1 * | 12/2011 | Meistrick | F01L 1/2411 123/90.46 |
| 2016/0281612 | A1 | 9/2016 | Toth et al. | |
| 2017/0175597 | A1 * | 6/2017 | Cecur | F01L 1/181 |

FOREIGN PATENT DOCUMENTS

| | | | |
|---|---|---|---|
| CN | 108167044 | A | 6/2018 |
| DE | 102006007121 | A1 | 8/2007 |
| KR | 20120032343 | A | 4/2012 |

OTHER PUBLICATIONS

EPO Extended European Search Report for corresponding EP Application No. 17936586.1; dated Jul. 30, 2021.

* cited by examiner

VALVE ROCKER ARM ASSEMBLY, VARIABLE AIR DISTRIBUTION MECHANISM AND ENGINE

CROSS REFERENCE TO RELATED APPLICATIONS

This is the U.S. national stage of international patent application No. PCT/CN2017/119260, filed on Dec. 28, 2017, the disclosure of which is incorporated herein by reference.

FIELD

The present application relates to the technical field of engines, and in particular to a valve rocker arm assembly. The present application further relates to a valve train mechanism including the valve rocker arm assembly and an engine including the valve train mechanism.

BACKGROUND

The valve train mechanism of the engine is a key mechanism for controlling the intake and exhaust of the engine. The valve train mechanism mainly includes a camshaft, a rocker arm, a rocker arm shaft, a rocker arm seat, a valve, a valve spring and the like. The opening and closing of the valve is completed by the cooperation of the camshaft, a tappet, and the rocker arm. The rocker arm is mounted to the rocker arm seat through the rocker arm shaft, one end of the rocker arm is driven by the tappet through the camshaft, and another end of the rocker arm abuts against a valve stem and is configured to control the opening and closing of the valve together with the valve spring.

The valve timing directly affects the intake and exhaust performance of the engine, and deeply affects the combustion process. In order to obtain better engine performance, the valve timing should be changed with changes in speed and load. Variable valve timing can meet the engines different requirements for valve timing at different speeds and loads, thereby improving engine performance and emissions, and better meeting the engine's power, economy and emissions requirements at high and low speeds, large and small loads.

An existing variable valve driving mechanism is an electro-hydraulic control variable valve mechanism, that is, a plunger is provided on the conventional engine valve train mechanism, and the lift of the plunger is superimposed on the lift of the conventional valve to realize variable valve timing or lift. The in and out of the pressure oil in the plunger chamber is controlled in real time by a high-speed, mass-flow solenoid valve. While each cylinder of the engine cycles once, the pressure oil enters and exits the plunger chamber once. The electro-hydraulic control variable valve mechanism is distinctively different from the conventional engine, and has a complicated structure. Since each cylinder of the engine works in turn, it is necessary to separately provide an electromagnetic control valve for each cylinder, and the cost is high. The engine speed is high, which requires fast on-off responses of the electromagnetic control valves. Besides, the control valves must meet the flow requirements, and are difficult to manufacture. Providing the electromagnetic control valve for each cylinder has strict timing requirements, which places higher requirements on the control system.

SUMMARY

In view of this, an object of the present application is to provide a valve rocker arm assembly to achieve variable valve timing, simplify the structure of a valve train mechanism, and improve the operation reliability.

Another object of the present application is to provide a variable valve train mechanism including the valve rocker arm assembly, so as to realize variable valve timing, simplify the structure of the valve train mechanism, and improve the operation reliability.

Yet another object of the present application is to provide an engine including the variable valve train mechanism to realize variable valve timing, simplify the structure of the valve train mechanism, and improve the operation reliability.

To achieve the above objects, the following technical solutions are provided according to the present application.

A valve rocker arm assembly includes:

an oil inlet hose;

a rocker arm shaft, wherein an oil drain channel, an oil return groove and a first oil path are provided in the rocker arm shaft, and the oil drain channel is in communication with the oil return groove through the first oil path;

a first rocker arm, which is rotatably connected to the rocker arm shaft;

a second rocker arm, which is rotatably connected to the rocker arm shaft, wherein the first rocker arm and the second rocker arm are located in a same rotation plane, the second rocker arm is provided with a piston chamber, an oil inlet path, an oil drain path and a piston, the piston is slidably arranged in the piston chamber, an extension end of the piston is configured to extend out of the piston chamber and push the first rocker arm, one end of the oil inlet path and one end of the oil drain path both are in communication with a space of the piston chamber located at a bottom of the piston, another end of the oil inlet path is connected to the oil inlet hose, and another end of the oil drain path is alternately connected or disconnected with the oil return groove as the second rocker arm swings;

a unidirectional communication device, which is provided in the oil inlet path and/or the oil inlet hose, and an oil-guiding direction thereof is toward the piston chamber; and a control valve, which is connected with the oil drain channel and is configured to control the on-off of the oil drain channel.

Preferably, in the above-described valve rocker arm assembly, the control valve is an electromagnetic on-off valve.

Preferably, in the above-described valve rocker arm assembly, working modes of the valve rocker arm assembly includes a valve normally-closing mode and a valve before-hand-closing mode. While in the valve normally-closing mode, the control valve is closed. while in the valve before-hand-closing mode, the control valve is opened.

Preferably, in the above-described valve rocker arm assembly, the unidirectional communication device is a check valve.

Preferably, in the above-described valve rocker arm assembly, an oil inlet connecting pipe is provided at the oil inlet of the oil inlet path, and the oil inlet hose is in communication with the oil inlet path through the oil inlet connecting pipe.

A variable valve train mechanism is further provided according to the present application, which includes a valve rocker arm, a camshaft, and a valve, wherein the valve rocker arm is the valve rocker arm assembly according to any one of the above aspects, one end of the first rocker arm of the valve rocker arm assembly is in driving connection with the valve, and one end of the second rocker arm of the valve rocker arm assembly is in driving connection with the camshaft.

Preferably, in the above-described variable valve train mechanism, one end of the first rocker arm is in driving connection with the valve through a valve bridge and a valve spring.

Preferably, in the above-described variable valve train mechanism, one end of the second rocker arm is in driving connection with the camshaft through a tappet.

Preferably, in the above-described variable valve train mechanism, the valve is an intake valve.

An engine is further provided according to the present application, which includes a valve train mechanism, wherein the valve train mechanism is the variable valve train mechanism according to any one of the above aspects.

Compared with the conventional technology, the present application has the following beneficial effects.

In the valve rocker arm assembly provided by the present application, the rocker arm is split into the first rocker arm and the second rocker arm, the first rocker arm and the second rocker arm are both rotatably connected to the rocker arm shaft, the rocker arm shaft is provided with the oil drain channel, the oil return groove and the first oil path, and the oil drain channel is in communication with the oil return groove through the first oil path; and the second rocker arm is provided with the piston, the piston chamber, the oil inlet path, the oil drain path, and the extension end of the piston is configured to extend out of the piston chamber and push the first rocker arm. One end of the oil inlet path and one end of the oil drain path both are in communication with the space of the piston chamber located at the bottom of the piston, another end of the oil inlet path is connected to the oil inlet hose, and another end of the oil drain path is alternately connected or disconnected with the oil return groove as the second rocker arm swings; the oil inlet path and/or the oil inlet hose is provided with the unidirectional communication device, and the oil guiding direction is toward the piston chamber; and the oil drain channel is provided with the control valve.

During operation, the engine oil enters the oil inlet hose from a main oil path of the engine, enters the piston chamber through the check valve and the oil inlet oil path, and pushes the extension end of the piston to stretch out. As the second rocker arm and the first rocker arm rotate around the rocker arm shaft, the oil return groove is connected to the oil drain path. Since the oil inlet path and/or the oil inlet hose is provided with the unidirectional communication device, the engine oil in the piston chamber can only enter the drain channel through the oil drain path, the oil return groove and the first oil path. If the control valve is opened, all the engine oil will be completely discharged, the piston will retract, and the second rocker arm will no longer push the first rocker arm to rotate, which is equivalent to shortening the length of the rocker arm and achieving beforehand-closing of the valve. If the control valve is closed, the engine oil cannot be discharged, the piston will remain in place, and the second rocker arm will continue to push the first rocker arm to rotate, thereby achieving normally-closing of the valve.

It can be seen that, according to the valve rocker arm assembly, the rocker arm is divided into two parts, and the piston is added onto the rocker arm, so that the length of the rocker arm is changed by the extension and retraction of the piston, and the normally-closing or beforehand-closing of the valve is realized by the mechanical structure, thereby improving the operation reliability.

The variable valve train mechanism and the engine according to the present application include the valve rocker arm assembly in the present application. Therefore, the structure is simplified while the variable timing of the valve is realized, and the operation reliability is improved.

BRIEF DESCRIPTION OF THE DRAWINGS

In order to more clearly describe the embodiments of the present application or the technical solutions in the conventional technology, the drawings referred to for describing the embodiments or the conventional technology will be briefly described below. Apparently, the drawings in the following description are merely embodiments of the present application. For those of ordinary skill in the art, other drawings may be obtained according to the provided drawings without creative efforts.

Reference numerals are listed as follows

Figure 1:
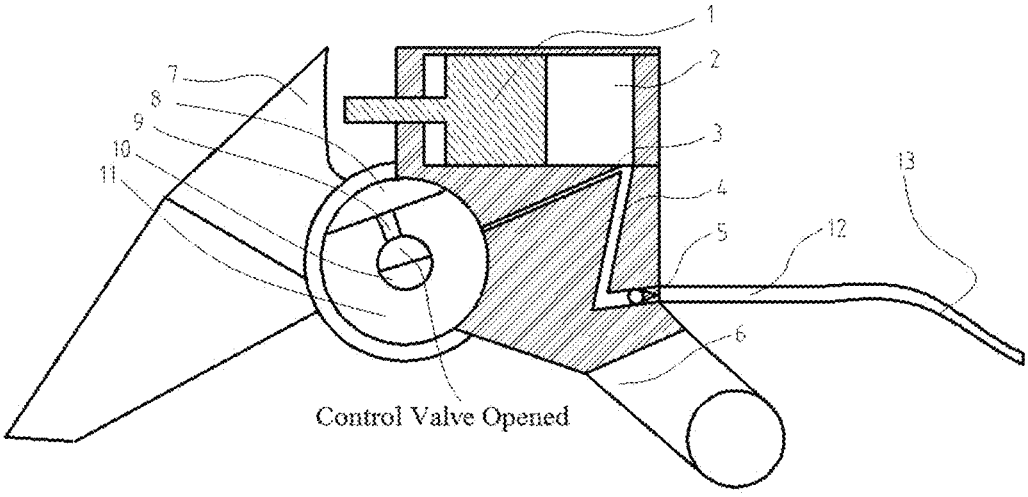
FIG. 1 is a schematic sectional view of a valve rocker arm assembly according to an embodiment of the present application where the valve rocker arm assembly is in a valve beforehand-closing mode, an oil drain path is not in communication with an oil return groove, a control valve is opened, and an oil drain channel is in communication with the oil return groove.
Figure 2:
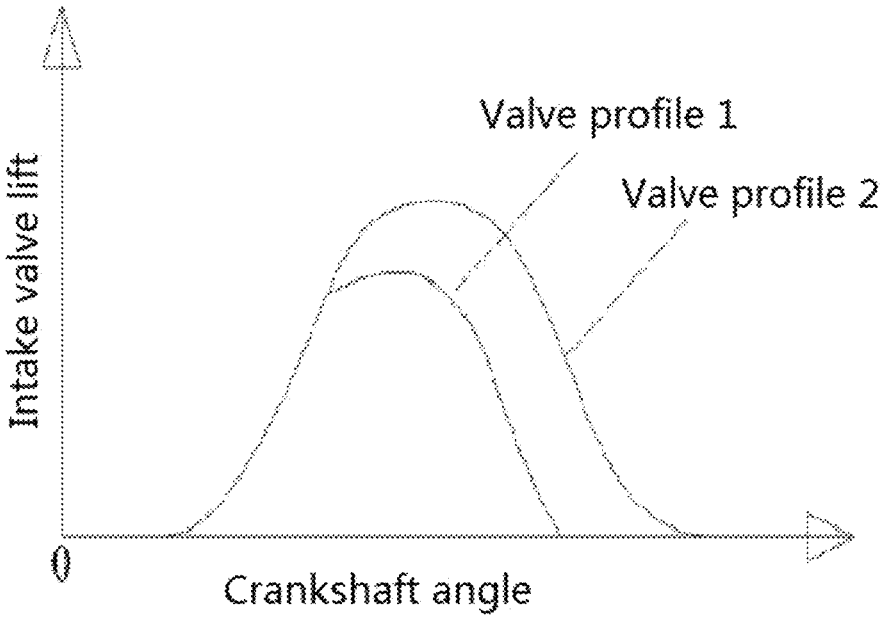
FIG. 2 is a schematic view of valve profiles of the valve rocker assembly according to an embodiment of the present application.

| | |
|---|---|
| 1 piston, | 2 piston chamber, |
| 3 oil drain path, | 4 oil inlet path, |
| 5 unidirectional communication device, | 6 second rocker arm, |
| 7 first rocker arm, | 8 oil return groove, |
| 9 first oil path, | 10 oil drain channel, |
| 11 rocker arm shaft, | 12 oil inlet connecting pipe, |
| 13 oil inlet hose. | |

DETAILED DESCRIPTION OF THE EMBODIMENTS

A core of the present application is to provide a valve rocker arm assembly, which realizes variable valve timing, simplifies the structure of a valve train mechanism and improves the operation reliability.

A variable valve train mechanism including the valve rocker arm assembly is further provided according to the present application, which realizes variable valve timing, simplifies the structure of the valve train mechanism, and improves the operation reliability.

An engine including the variable valve train mechanism is further provided according to the present application, which realizes variable valve timing, simplifies the structure of the valve train mechanism, and improves the operation reliability.

The technical solutions in the embodiments of the present application will be clearly and completely described in the following with reference to the drawings in the embodiments of the present application. Apparently, the described embodiments are only a part of the embodiments of the present application, rather than all the embodiments. Based on the embodiments of the present application, all other embodiments obtained without creative efforts by those of ordinary skill in the art shall fall within the protection scope of the present application.

Referring to FIGS. 1, 2, and 5A to 5C, a valve rocker arm assembly is provided according to an embodiment of the present application, which includes an oil inlet hose 13, a rocker shaft 11, a first rocker arm 7, a second rocker arm 6, a unidirectional communication device 5 and a control valve. An oil drain channel 10, an oil return groove 8 and a first oil path 9 are provided in the rocker arm shaft 11. The oil inlet hose 13 is configured to communicate with an engine main oil path, and the oil drain channel 10 is in communication with the oil return groove 8 through the first oil path 9.

Figure 5A:
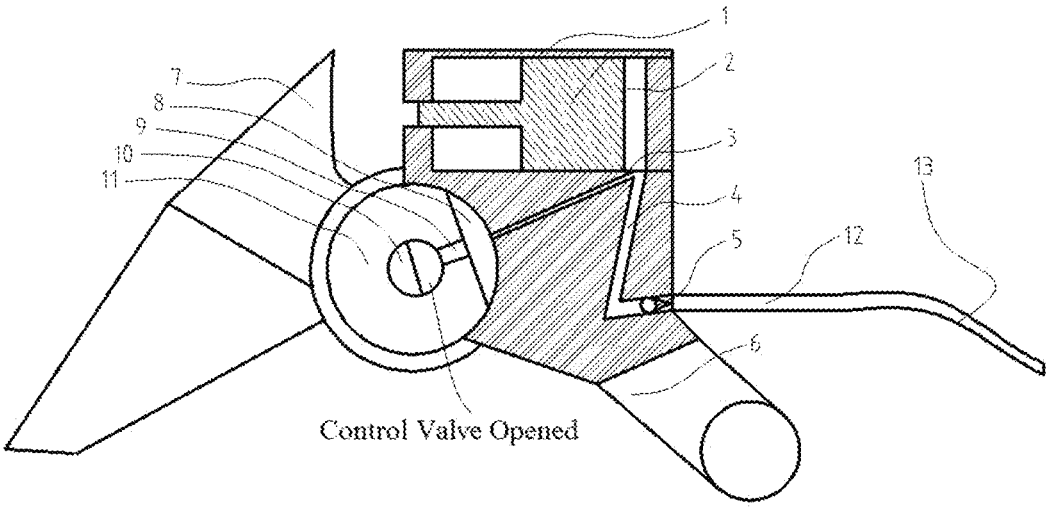
FIG. 5A is another schematic sectional view of the valve rocker arm assembly according to an embodiment of the present application, where the valve rocker arm assembly is in the valve beforehand-closing mode, the oil drain path is in communication with the oil return groove, the control valve is opened, and the oil drain channel is in communication with the oil return groove.

The first rocker arm 7 is rotatably connected to the rocker arm shaft 11, and the second rocker arm 6 is rotatably connected to the rocker arm shaft 11. The first rocker arm 7 and the second rocker arm 6 are located in a same rotation plane, that is, the rocker arm is split into two parts. The second rocker arm 6 is provided with a piston chamber 2, an oil inlet path 4, an oil drain path 3 and a piston 1. The piston 1 is slidably arranged in the piston chamber 2, and an extension end of the piston 1 is capable of stretching out of the piston chamber 2 and pushing the first rocker arm 7, that is, the second rocker arm 6 is capable of pushing the first rocker arm 7 to rotate through the extension end of the piston 1. One end of the oil inlet path 4 and one end of the oil drain path 3 both are in communication with a space of the piston chamber 2 located at a bottom of the piston 1, another end of the oil inlet path 4 is connected to the oil inlet hose 13, and another end of the oil drain path 3 is alternately connected or disconnected with the oil return groove 8 as the second rocker arm 6 swings, as shown in FIGS. 1 and 5A.

The unidirectional communication device 5 is provided in the oil inlet path 4 and/or the oil inlet hose 13, and an oil guiding direction of the unidirectional communication device 5 is toward the piston chamber 2, which only allows the engine oil to enter the piston chamber 2 from the oil inlet hose 13 and the oil inlet path 4, and does not allow the engine oil in the piston chamber 2 to flow back to the oil inlet path 4 or the oil inlet hose 13.

The control valve is arranged in the oil drain channel 10 and is configured to control the on-off of the oil drain channel 10.

The valve rocker arm assembly has two working modes, namely a valve normally-closing mode and a valve beforehand-closing mode. While the valve rocker arm assembly is in the valve beforehand-closing mode, the control valve is opened, that is, the oil drain channel 10 is in communication with the oil return groove 8, as shown in FIGS. 1 and 5A; while the valve rocker arm assembly is in the valve normally-closing mode, the control valve is closed, that is, the oil drain channel 10 is not in communication with the oil return groove 8, as shown in FIG. 5B and FIG. 5C.

Specifically, as shown in FIG. 1A, while the valve rocker arm assembly is operated in the valve beforehand-closing mode, the second rocker arm 6 is in an initial position where the oil drain path 3 is not in communication with the oil return groove 8, and the engine oil enters the oil inlet hose 13 from the engine main oil path, then enters the piston chamber 2 through the oil inlet path 4 and pushes the extension end of the piston 1 to stretch out; the extension end of the piston 1 is in contact with the first rocker arm 7, and the second rocker arm 6 pushes the first rocker arm 7 to rotate around the rocker arm shaft 11 together through the extension end of the piston 1; and, as shown in FIG. 5A, as the second rocker arm 6 and the first rocker arm 7 rotate around the rocker arm shaft 11, the oil return groove 8 communicates with the oil drain path 3. Since the oil inlet path 4 and/or the oil inlet hose 13 is provided with the unidirectional communication device 5, the engine oil in the piston chamber 2 can only enter the oil drain channel 10 through the oil drain path 3, the oil return groove 8 and the first oil path 9. In this working mode, the control valve is opened and the oil drain channel 10 is in communication with the oil return groove 8, so that the engine oil is completely discharged, the piston 1 retracts, and the second rocker arm 6 no longer pushes the first rocker arm 7 to rotate, which is equivalent to shortening the length of the rocker arm, as shown in FIG. 5A. The valve operates according to the valve profile 1 in FIG. 2, achieving the beforehand-closing of the valve.

Figure 5B:
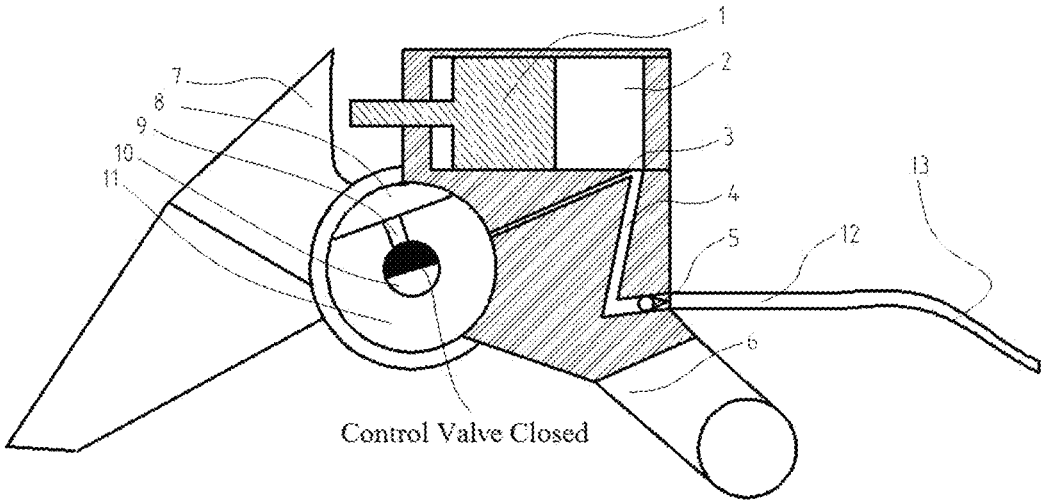
FIG. 5B is another schematic sectional view of the valve rocker arm assembly according to an embodiment of the present application, where the valve rocker arm assembly is in a valve normally-closing mode, the oil drain path is not in communication with the oil return groove, the control valve is closed, and the oil drain channel is not in communication with the oil return groove.
Figure 5C:
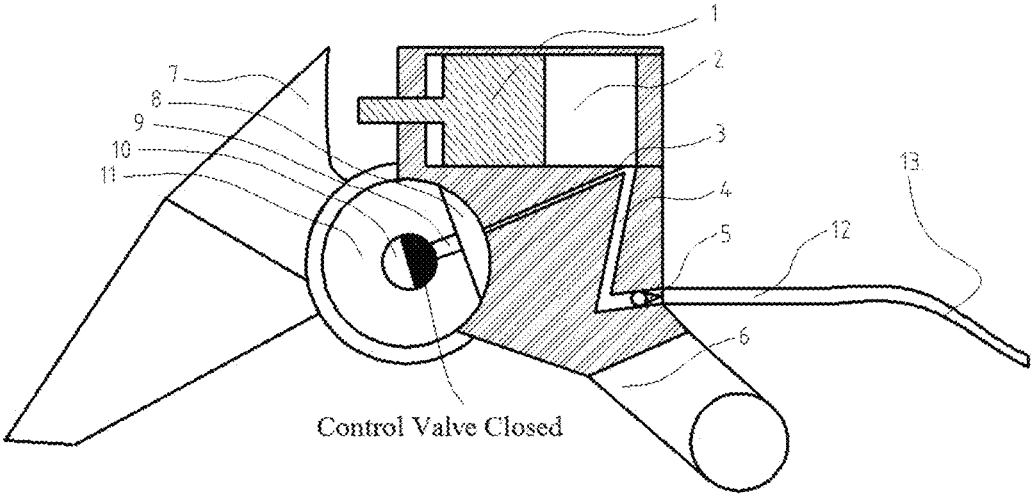
FIG. 5C is another schematic sectional view of the valve rocker arm assembly according to an embodiment of the present application, where the valve rocker arm assembly is in the valve normally-closing mode, the oil drain path is in communication with the oil return groove, the control valve is closed, and the oil drain channel is not communication with the oil return groove.

As shown in FIG. 5B, while the valve rocker arm assembly is operated in the valve normally-closing mode, the second rocker arm 6 is in an initial position where the oil drain path 3 is not in communication with the oil return groove 8, and the engine oil enters the oil inlet hose 13 from the engine main oil path, then enters the piston chamber 2 through the oil inlet path 4 and pushes the extension end of the piston 1 to stretch out; the extension end of the piston 1 is in contact with the first rocker arm 7, and the second rocker arm 6 pushes the first rocker arm 7 to rotate around the rocker arm shaft 11 together; and, as shown in FIG. 5C, as the second rocker arm 6 and the first rocker arm 7 rotate around the rocker arm shaft 11, the oil return groove 8 communicates with the oil drain path 3. Since the oil inlet path 4 and/or the oil inlet hose 13 is provided with the unidirectional communication device 5, the engine oil in the piston chamber 2 can only enter the oil drain channel 10 through the oil drain path 3, the oil return groove 8 and the first oil path 9. In this working mode, the control valve is closed and the oil drain channel 10 is not in communication with the oil return groove 8, so that the engine oil cannot be discharged, the piston 1 remains in place, and the second rocker arm 6 still pushes the first rocker arm 7 to rotate, which is equivalent to increasing the length of the rocker arm, as shown in FIG. 5C. The valve operates according to the valve profile 2 in FIG. 2, achieving the normally-closing of the valve.

It can be seen that, according to the valve rocker arm assembly, the rocker arm is divided into two parts, and the piston 1 is added onto the rocker arm, so that the length of the rocker arm is changed by the extension and retraction of the piston 1 through the design of the oil circuit, and the normally-closing or beforehand-closing of the valve is realized by the mechanical structure. Compared with the existing variable timing of the valve realized by a complicated electromagnetic control system, the operation reliability is improved, no major changes to the engine are required, and the structure is simple and reliable.

In the present embodiment, the control valve is preferably an electromagnetic on-off valve. Apparently, the control valve may be an electric valve, a hydraulic valve, or the like. The electromagnetic on-off valve can achieve fast response and more accurate control.

As shown in FIG. 1A, furthermore, in the present embodiment, the unidirectional communication device 5 is a check valve, and the oil-guiding direction of the check valve is toward the piston chamber 2. By providing the check valve in the oil inlet path 4 and/or the oil inlet hose 13, the engine oil in the piston chamber 2 can be prevented from flowing back into the oil inlet path 4 and the oil inlet hose 13. Apparently, the unidirectional communication device 5 may be a control valve. When the oil is fed, the control valve is opened, and when the second rocker arm 6 is rotated to a position where the oil drain path 3 communicates with the oil return groove 8, the control valve is closed, which also realizes the unidirectional communication. However, this configuration is not as simple as the check valve, and has lower reliability.

In present embodiment, an oil inlet connecting pipe 12 is provided at the oil inlet of the oil inlet path 4, and the oil inlet hose 13 is always in communication with the oil inlet path 4 through the oil inlet connecting pipe 12. The oil inlet hose 13 is capable of deformation as the second rocker arm 6 swings. The provision of the oil inlet connecting pipe 12 facilitates the connection between the oil inlet hose 13 and the oil inlet path 4. The oil inlet connecting pipe 12 is fixed at the inlet of the oil inlet path 4 by welding or threaded connection. The oil inlet hose 13 is fitted to the oil inlet connecting pipe 12.

Apparently, the oil inlet hose 13 may be directly connected to the inlet of the oil inlet path 4 and may be fixed thereto by means of adhesion or the like.

Based on the valve rocker arm assembly according to any one of the above aspects, a variable valve train mechanism is further provided according to an embodiment of the present application, which includes a valve rocker arm, a camshaft, and a valve, wherein the valve rocker arm is the valve rocker arm assembly according to any one of the above aspects, one end of the first rocker arm 7 of the valve rocker arm assembly is in driving connection with the valve, and one end of the second rocker arm 6 of the valve rocker arm assembly is in driving connection with the camshaft.

During operation, the camshaft rotates, driving the second rocker arm 6 to rotate around the rocker arm shaft 11 and pushing the first rocker arm 7 to rotate. One end of the first rocker arm 7 drives the valve to open or close. Since the valve rocker arm assembly in the present application is used, variable timing of the valve can be achieved, and beforehand-closing or normally-closing of the valve can be achieved. The structure is simple and the operation is reliable.

Figure 3:
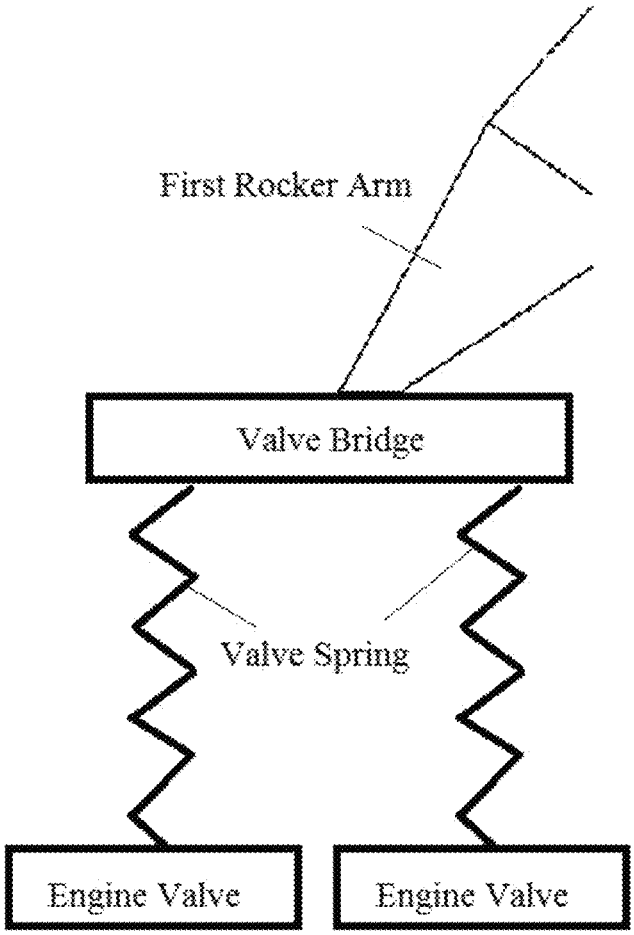
FIG. 3 shows that one end of a first rocker arm is in driving connection with an engine valve through a valve bridge and a valve spring.

In the present embodiment, one end of the first rocker arm 7 is in driving connection with the valve through a valve bridge and a valve spring, as shown in FIG. 3. For a conventional four-stroke engine, the valves are in pairs, such that the opening and closing of two valves are driven by the valve bridge. The valve spring plays the role of elastic restoration.

Figure 4:
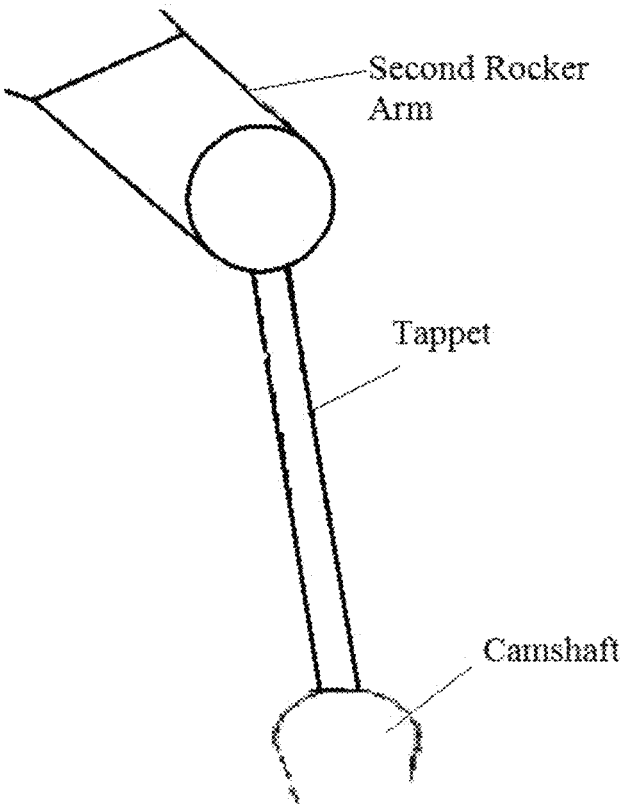
FIG. 4 shows that one end of a second rocker arm is in driving connection with a camshaft through a tappet.

In the present embodiment, one end of the second rocker arm 6 is in driving connection with the camshaft through a tappet as shown in FIG. 4. For a valve train mechanism with camshaft in a lower position or a valve train mechanism with camshaft in a middle position, the rocker arm needs to be in driving connection with the camshaft through the tappet. Apparently, for a valve train mechanism with camshaft in a top position, one end of the second rocker arm 6 is directly connected to the camshaft.

In the present embodiment, the valve is preferably an intake valve. Through the driving connection between the valve rocker arm assembly and the intake valve, the beforehand-closing or normally-closing of the intake valve can be realized, and the opening moment of the intake valve does not change. Apparently, if the design requires, the valve may be an exhaust valve to realize the beforehand-closing or normally-closing of the exhaust valve.

Based on the variable valve train mechanism described in any one of the above embodiments, an engine is further provided according to an embodiment of the present application, which includes a valve train mechanism, wherein the valve train mechanism is the variable valve train mechanism according to any one of the above embodiments. Since the variable valve train mechanism in the present application is used, variable timing of the valve can be achieved, and beforehand-closing or normally-closing of the valve can be achieved. The structure is simple and the operation is reliable.

The embodiments in this specification are described in a progressive manner, and each embodiment focuses on the differences from other embodiments. For the same or similar parts among the embodiments, reference may be made to each other.

According to the above description of the disclosed embodiments, those skilled in the art can implement or practice the present application. Various modifications to these embodiments will be apparent to those skilled in the art, and the general principles defined herein may be implemented in other embodiments without departing from the spirit or scope of the present application. Therefore, the present application shall not be limited to the embodiments shown herein, but shall conform to the widest scope consistent with the principles and novel features disclosed herein.

The invention claimed is:

1. A valve rocker arm assembly, comprising an oil inlet hose;

a rocker arm shaft, wherein an oil drain channel, an oil return groove and a first oil path are provided in the rocker arm shaft, and the oil drain channel is in communication with the oil return groove through the first oil path;

a first rocker arm, which is rotatably connected to the rocker arm shaft;

a second rocker arm, which is rotatably connected to the rocker arm shaft, wherein the first rocker arm and the second rocker arm are located in a same rotation plane, the second rocker arm is provided with a piston chamber, an oil inlet path, an oil drain path and a piston, the piston is slidably arranged in the piston chamber, an extension end of the piston is configured to extend out of the piston chamber and push the first rocker arm, one end of the oil inlet path and one end of the oil drain path both are in communication with a space of the piston chamber located at a bottom of the piston, another end of the oil inlet path is connected to the oil inlet hose, and another end of the oil drain path is alternately connected with or disconnected from the oil return groove as the second rocker arm swings during a swing cycle of the second rocker arm;

a unidirectional communication device, which is provided in the oil inlet path and/or the oil inlet hose, and an oil-guiding direction of the unidirectional communication device is toward the piston chamber; and a control valve, which is connected with the oil drain channel and is configured to actively control communication between the oil drain channel and the oil return groove.

2. The valve rocker arm assembly according to claim 1, wherein the control valve is an electromagnetic on-off valve.

3. The valve rocker arm assembly according to claim 1, wherein working modes of the valve rocker arm assembly comprises a valve normally-closing mode and a valve beforehand-closing mode; while in the valve normally-closing mode, the control valve is closed; while in the valve beforehand-closing mode, the control valve is opened.

4. The valve rocker arm assembly according to claim 1, wherein the unidirectional communication device is a check valve.

5. The valve rocker arm assembly according to claim 1, wherein an oil inlet connecting pipe is provided at an oil inlet of the oil inlet path, and the oil inlet hose is in communication with the oil inlet path through the oil inlet connecting pipe.

6. A variable valve train mechanism, comprising a valve rocker arm, a camshaft and an engine valve, wherein the valve rocker arm is a valve rocker arm assembly comprising:

an oil inlet hose;

a rocker arm shaft, wherein an oil drain channel, an oil return groove and a first oil path are provided in the rocker arm shaft, and the oil drain channel is in communication with the oil return groove through the first oil path;

a first rocker arm, which is rotatably connected to the rocker arm shaft;

a second rocker arm, which is rotatably connected to the rocker arm shaft, wherein the first rocker arm and the second rocker arm are located in a same rotation plane, the second rocker arm is provided with a piston chamber, an oil inlet path, an oil drain path and a piston, the piston is slidably arranged in the piston chamber, an extension end of the piston is configured to extend out of the piston chamber and push the first rocker arm, one end of the oil inlet path and one end of the oil drain path both are in communication with a space of the piston chamber located at a bottom of the piston, another end of the oil inlet path is connected to the oil inlet hose, and another end of the oil drain path is alternately connected with or disconnected from the oil return groove as the second rocker arm swings during a swing cycle of the second rocker arm;

a unidirectional communication device, which is provided in the oil inlet path and/or the oil inlet hose, and an oil-guiding direction of the unidirectional communication device is toward the piston chamber; and a control valve, which is connected with the oil drain channel and is configured to actively control communication between the oil drain channel and the oil return groove;

one end of the first rocker arm of the valve rocker arm assembly is in driving connection with the engine valve, and one end of the second rocker arm of the valve rocker arm assembly is in driving connection with the camshaft.

7. The variable valve train mechanism according to claim 6, wherein the one end of the first rocker arm is in driving connection with the engine valve through a valve bridge and a valve spring.

8. The variable valve train mechanism according to claim 7, wherein the engine valve is an intake valve.

9. The variable valve train mechanism according to claim 6, wherein the one end of the second rocker arm is in driving connection with the camshaft through a tappet.

10. The variable valve train mechanism according to claim 9, wherein the engine valve is an intake valve.

11. The variable valve train mechanism according to claim 6, wherein the engine valve is an intake valve.

12. The variable valve train mechanism according to claim 6, wherein the control valve is an electromagnetic on-off valve.

13. The variable valve train mechanism according to claim 6, wherein working modes of the valve rocker arm assembly comprises a valve normally-closing mode and a valve beforehand-closing mode; while in the valve normally-closing mode, the control valve is closed; while in the valve beforehand-closing mode, the control valve is opened.

14. The variable valve train mechanism according to claim 6, wherein the unidirectional communication device is a check valve.

15. The variable valve train mechanism according to claim 6, wherein an oil inlet connecting pipe is provided at an oil inlet of the oil inlet path, and the oil inlet hose is in communication with the oil inlet path through the oil inlet connecting pipe.

16. An engine comprising a valve train mechanism, wherein the valve train mechanism comprises a valve rocker arm assembly, a camshaft and an engine valve, and the valve rocker arm assembly comprises:

an oil inlet hose;

a rocker arm shaft, wherein an oil drain channel, an oil return groove and a first oil path are provided in the rocker arm shaft, and the oil drain channel is in communication with the oil return groove through the first oil path;

a first rocker arm, which is rotatably connected to the rocker arm shaft;

a second rocker arm, which is rotatably connected to the rocker arm shaft, wherein the first rocker arm and the second rocker arm are located in a same rotation plane, the second rocker arm is provided with a piston chamber, an oil inlet path, an oil drain path and a piston, the piston is slidably arranged in the piston chamber, an extension end of the piston is configured to extend out of the piston chamber and push the first rocker arm, one end of the oil inlet path and one end of the oil drain path both are in communication with a space of the piston chamber located at a bottom of the piston, another end of the oil inlet path is connected to the oil inlet hose, and another end of the oil drain path is alternately connected with or disconnected from the oil return groove as the second rocker arm swings during a swing cycle of the second rocker arm;

a unidirectional communication device, which is provided in the oil inlet path and/or the oil inlet hose, and an oil-guiding direction of the unidirectional communication device is toward the piston chamber; and a control valve, which is connected with the oil drain channel and is configured to actively control communication between the oil drain channel and the oil return groove;

one end of the first rocker arm of the valve rocker arm assembly is in driving connection with the engine valve, and one end of the second rocker arm of the valve rocker arm assembly is in driving connection with the camshaft.

17. The engine according to claim 16, wherein the one end of the first rocker arm is in driving connection with the engine valve through a valve bridge and a valve spring.

18. The engine according to claim 16, wherein the one end of the second rocker arm is in driving connection with the camshaft through a tappet.

19. The engine according to claim 16, wherein the engine valve is an intake valve.

* * * * *